US005161462A

United States Patent [19]

Okamura et al.

[11] Patent Number: 5,161,462

[45] Date of Patent: Nov. 10, 1992

[54] INK SUPPLYING APPARATUS IN ROTARY PRESS

[75] Inventors: Yuichi Okamura, Tokyo; Yuko Tomita, Akishima, both of Japan

[73] Assignee: Tokyo Kikai Seisakusho, Ltd., Tokyo, Japan

[21] Appl. No.: 612,060

[22] Filed: Nov. 13, 1990

[30] Foreign Application Priority Data

Nov. 17, 1989 [JP] Japan ..... 1-297274

[51] Int. Cl.[5] ..... B41F 1/40; B41F 31/00

[52] U.S. Cl. ..... 101/207; 101/209; 101/365

[58] Field of Search ..... 101/350, 351, 363, 365, 101/232, 207, 208, 209, 210; 118/259, 261, 262, 267

[56] References Cited

U.S. PATENT DOCUMENTS 3,500,745 3/1970 Neal ..... 101/207
3,611,921 10/1971 Jahn ..... 101/232 X
4,373,442 2/1983 Dahlgren ..... 101/207
4,479,434 10/1984 Armelin ..... 101/365
4,481,883 11/1984 Savart et al. ..... 101/365 X
4,488,485 12/1984 Bolza-Schunemann ..... 101/350
4,703,715 11/1987 Scheffer ..... 118/203
4,935,683 6/1990 Kobler et al. ..... 101/350 X

FOREIGN PATENT DOCUMENTS 45-31843 12/1970 Japan .

*Primary Examiner*—Edgar S. Burr
*Assistant Examiner*—Moshe I. Cohen
*Attorney, Agent, or Firm*—Armstrong & Kubovcik

[57] ABSTRACT

Disclosed is an ink supplying apparatus which can drive and rotate a fountain roller at an arbitrary speed independently of the peripheral speed of a roller adjacent to the fountain roller when an ink fountain is fitted to a rotary press, which does not require large-scale maintenance and inspection, which is free from any danger, and which is equipped with an ink fountain having a fountain roller capable of being fitted to and removed from a suitable position corresponding to a maximum printing width.

3 Claims, 3 Drawing Sheets

INK SUPPLYING APPARATUS IN ROTARY PRESS

BACKGROUND OF THE INVENTION

1. Field of the Invention

This invention relates to an apparatus for supplying ink in a rotary press, and more particularly, to an apparatus for supplying ink wherein a fountain roller is rotatably disposed in an ink fountain having a width smaller than the maximum printing width of a rotary press.

2. Description of the Prior Art

Devices for supplying ink in the prior art wherein a fountain roller is disposed rotatably in an ink fountain having a width smaller than the maximum printing width of a rotary press are disclosed in U.S. Pat. No. 3,500,745 (hereinafter referred to as "prior art technique No. 1"), Japanese Utility Model Publication No. 31843/1970 (hereinafter referred to as "prior art technique No. 2"), U.S. Pat. No. 4,373,442 (hereinafter referred to as "prior art technique No. 3"), and so forth.

These prior art techniques are directed to the supply of several kinds of ink having different colors to various portions along the maximum printing width in a rotary press; to the partial supply of such ink; or to make ink exchange possible for each different portion along the maximum printing width.

In all of these prior art techniques, a fountain roller is disposed in an ink fountain removably fitted to the press. When the ink fountain is fitted to the press, the fountain roller can approach, or come into contact with, adjacent rollers. When the ink fountain is fitted to the press, the fountain roller rotates while part of it is dipped in ink inside the ink fountain so that its peripheral surface guides out ink and transfers and supplies it to the adjacent rollers.

In prior art technique No. 1, a gear is disposed on a driving shaft connected to a driving source and when the ink fountain is fitted to the press, the gear described above meshes with another gear disposed at the shaft end of the fountain roller and the fountain roller is thus driven for rotation.

In other words, the fountain roller can be rotated even though it does not come into contact with the adjacent roller and the ink supply can be made by changing the peripheral speed of rotation of the fountain roller and the adjacent rollers. Accordingly, in a rotary press that operates at a high speed, the peripheral speed of the fountain can be set to a speed at which ink can sufficiently attach to its peripheral surface, and to a speed at which ink inside the ink fountain is not stirred markedly. Therefore, scatter of ink and admixture of bubbles into ink can be restricted.

In prior art technique No. 2, the fountain roller can come into contact with the adjacent roller when the ink fountain is fitted to the press and is rotated together with the rotation of the adjacent roller which is interconnected to the driving source and driven for rotation.

In prior art technique No. 3, the fountain roller and a downstream roller coming into contact with the fountain roller are disposed in the ink fountain, the downstream roller comes into contact with its adjacent roller when the ink fountain is fitted to the press, and the downstream roller is rotated together with the adjacent roller which is interconnected to the driving source and driven for rotation. Furthermore, the fountain roller is rotated through this downstream roller.

Prior art techniques Nos. 2 and 3 described above have a structure such that when the fountain roller disposed in the ink fountain, or the downstream roller coming into contact with the fountain roller comes into contract with the adjacent roller which is driven for rotation, the fountain roller is rotated with the rotation of the adjacent roller. Since any driving shaft for driving the fountain roller is thus unnecessary, maintenance and inspection around the driving shaft is not necessary and the danger that might occur if this driving shaft and gears disposed on the driving shaft exist does not occur.

The prior art technique No. 1 needs maintenance and inspection around the driving shaft which drives the fountain roller. Since the driving shaft and the gear disposed on the driving shaft rotate with the operation of the press even when the ink fountain is not fitted, they can present hazards to the operator. Furthermore, the fitting position of the ink fountain and its size are limited by the position of the gear disposed on the driving shaft. Since the gear ratio is constant between the gear disposed on the driving shaft and the gear disposed at the shaft end of the fountain roller, the peripheral speed of the fountain roller cannot be changed, even though such a change is desired, without changing the peripheral speed of the adjacent roller, such as when it is desired to change the take-out quantity of ink or when ink having an extremely high or low viscosity is used.

In prior art techniques Nos. 2 and 3, the fountain roller is rotated with the rotation of the adjacent roller. Therefore, there is the possibility of the rotary press operating at such a high speed that the peripheral speed of the fountain roller is so high that ink cannot sufficiently attach to the peripheral surface of the fountain roller, or ink inside the ink fountain is stirred so much that scatter of ink and admixture of bubbles into ink are invited. Furthermore, slippage is likely to occur between the rollers that are in mutual contact with one another and non-uniform rotation of the fountain roller is likely to occur to some extent. Even when it is desired to change the peripheral speed of the fountain roller, it is not possible without changing the peripheral speed of the adjacent roller in the same way as the prior art technique No. 1.

SUMMARY OF THE INVENTION

It is therefore a primary object of the present invention to provide an ink supplying apparatus which can drive and rotate a fountain roller by selecting an arbitrary peripheral speed for it independently of the peripheral speed of a roller adjacent to it when an ink fountain is fitted to a rotary press, which reduces the need for large-scale maintenance and inspection, and which is relatively safe. Preferably, the ink supplying apparatus of the present invention is equipped with an ink fountain having a fountain roller which can be fitted to and removed from a suitable position corresponding to the maximum printing width.

An ink supplying apparatus in a rotary press in accordance with the present invention comprises an ink fountain having a width smaller than the maximum printing width of a rotary press, a fountain roller disposed rotatably in the ink fountain, rotation driving means for the fountain roller fitted integrally to the ink fountain, a rotation speed controller capable of being connected to the rotation driving means, and a fixing device for removably fitting the ink fountain to a frame portion of the rotary press at a suitable position of the maximum printing width. The ink fountain is fitted to the fixing device so that it is capable of inclining freely around the axis in a transverse direction. A doctor blade may be disposed adjacent to the ink fountain in such a manner as to come into contact with, and separate from, the peripheral surface of an ink roller adjacent to the fountain roller or the peripheral surface of the fountain roller.

The ink fountain is fitted to the frame portion of the rotary press by a fixing device so that it is positioned at a suitable position along the maximum printing width, and ink is supplied into the ink fountain. Then, the fountain roller comes into contact with, or approaches, the adjacent roller in the ink supply path, and part of its peripheral surface is dipped into ink.

Next, the fountain roller is driven for rotation by the rotating driving means. Its rotating speed is controlled to a suitable speed by the rotation speed controller.

Ink inside the ink fountain is guided out by the peripheral surface of the rotating fountain roller, is transferred to the peripheral surface of the adjacent roller and is sequentially transferred and supplied to a printing plate surface through the ink supply path.

After the operation of the rotary press is complete or when ink is changed (such as the change of ink color), the ink fountain is removed from the frame portion of the rotary press and then the ink supply path from the adjacent roller to the plate surface is washed. In the case of the ink change, the ink fountain having fresh ink is fitted to the frame portion of the rotary press in the same way as described above and fresh ink is supplied into the ink fountain.

The above and other objects and novel features of the present invention will become more apparent from the following description when taken in conjunction with the accompanying drawings.

DESCRIPTION OF THE PREFERRED EMBODIMENT

Hereinafter, a preferred embodiment of the present invention will be described with reference to the accompanying drawings.

Figure 1:
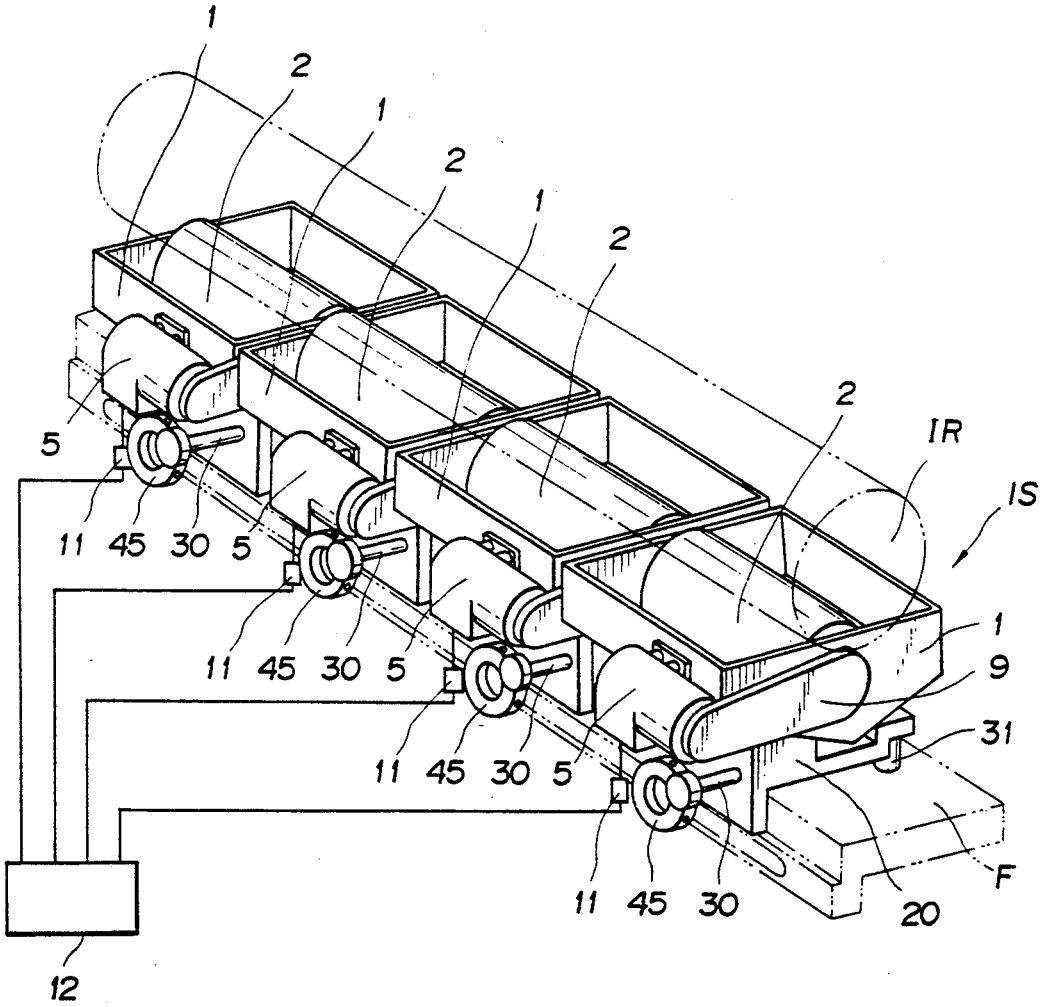
FIG. 1 is a schematic perspective view of an ink supplying apparatus in a rotary press in accordance with an embodiment of the present invention.

In FIG. 1, a plurality (four, in the drawing) of ink supplying apparatuses IS is shown disposed in alignment on an ink supplying apparatus fitting portion F which constitutes a frame of a rotary press (not shown) and is in parallel with the axis of a form cylinder (not shown).

Figure 2:
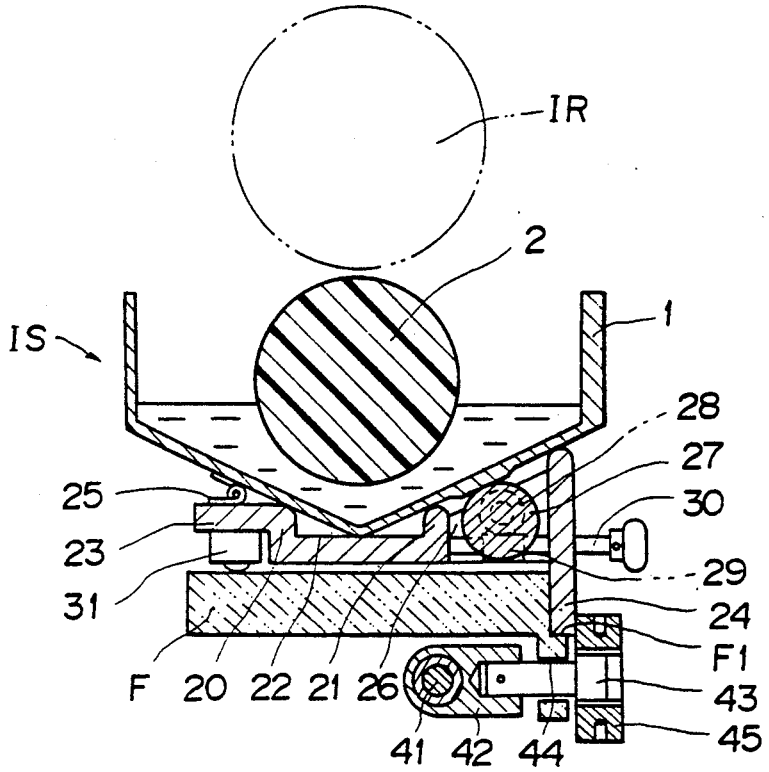
FIG. 2 is a transverse sectional view of the ink supplying apparatus in a rotary press in the embodiment of the present invention (with the portions associated with driving means being omitted; see FIG. 1)

In each ink supplying apparatus IS, an ink fountain 1 which has a width smaller than the maximum printing width of the rotary press has a triangular section as shown in FIG. 2. A fountain roller 2 consisting of a shaft portion 2' and a cylindrical outer peripheral member 2" fitted to the shaft portion 2' is fitted into the ink fountain 1 in a longitudinal direction so that when the ink supplying apparatus IS is fitted, the ink fountain roller 2 is adjacent to the lower side of a roller IR of the rotary press. The lower portion of this fountain roller 2 is dipped into ink stored inside the ink fountain 1. Both ends of the shaft portion 2' are supported rotatably on both side walls of the ink fountain 1 by bearings 3, 3 and one of its ends projects from the side wall of the ink fountain 1. A toothed pulley 4 is fitted to this end portion.

A motor 5 is fixed to the front side wall of the ink fountain 1 and a toothed pulley 7 is fitted to the output shaft 6 of the motor 5. A timing belt 8 is wound on both toothed pullies 4 and 7, constituting thereby fountain roller driving means. Both toothed pullies 4, 7 and the timing belt 8 are covered with a cover 9.

The motor 5 is connected to a rotation speed controller 12 through a connector 11 and the rotation speed controller 12 is connected to a rotary press controller (not shown), whenever necessary, so that the operation of the rotation speed controller 12 is started simultaneously with the start of the operation of the rotary press and the rotating speed of the motor 5 is brought into conformity with the operating speed of the rotary press.

The ink fountain 1 is fitted to a bed 20 in such a manner as to be capable of inclining round the axis in the transverse direction and the bed 20 is fitted to the ink supplying apparatus fitting portion F in such a manner that its position can be freely adjusted in the longitudinal direction.

The bed 20 has the section such as shown in FIG. 2.

The bed 20 consists of a front inclined bed portion 21, an intermediate recess portion 22, a rear bed portion 23 and a front suspension wall portion 24 that extend in the longitudinal direction, respectively, and the bottom surface of the ink fountain 1 is supported by the front inclined bed portion 21, the intermediate recess portion 22 and the rear bed portion 23, and is fitted onto the rear bed portion 23 by hinges 25.

A recess portion 26 is defined in the front inclined bed portion 21 and an eccentric cam 27 and worm wheel 28 are fitted into this recess 26 so as to be rotatable round the axis in the transverse direction and integrally with each other. A worm 29 meshing with the worm wheel 28 is further fitted rotatably and an operation shaft 30 which is on the same axis as the worm 29 projects forward to the front surface of the front inclined bed portion 21.

Accordingly, the peripheral surface of the eccentric cam 27 can be brought into contact with the bottom surface of the ink fountain 1.

When each ink supplying apparatus IS is mounted, the front suspension wall portion 24 of the bed 20 is supported slidably by the front step portion F1 of the ink supplying apparatus fitting portion F, the back of the front suspension wall portion 24 comes into contact with the front side surface of the ink supplying apparatus fitting portion F and casters 31 for movement, which are fitted to the lower surface of the rear bed portion 23, are supported by the upper surface of the ink supplying apparatus fitting portion F.

A guide rod 41 is disposed below the ink supplying apparatus fitting portion F in the longitudinal direction and slidable piece 42 are fitted slidably to the guide rod 41. A male screw 43 fitted to the slidable piece 42 protrudes from a guide groove hole 44 in the longitudinal direction which is formed at the front projecting portion of the ink supplying apparatus fitting portion F and a female screw 45 is meshed with the male screw 43. In this manner, the lower edge portion of the front suspension wall portion 24 of the bed 20 is clamped between the front side surface of the ink supplying apparatus fitting portion F and the female screw 45.

Figure 6:
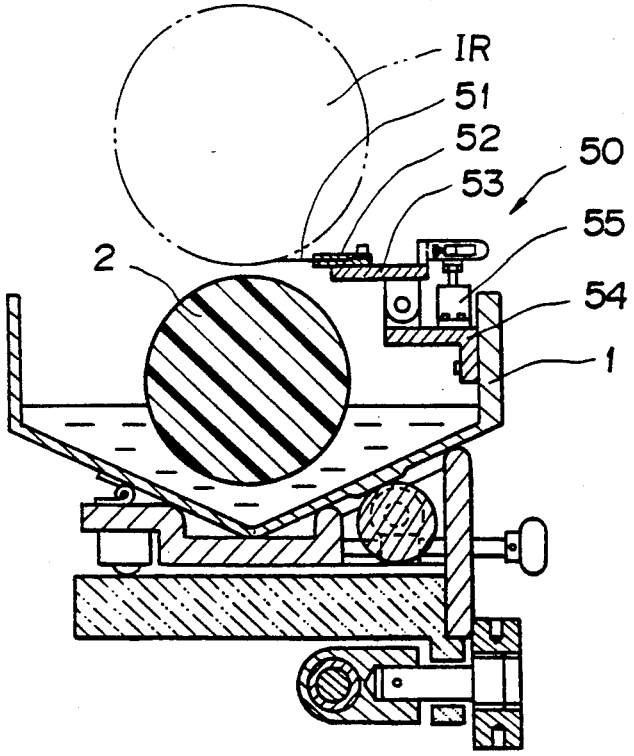
FIG. 6 is a transverse sectional view when doctor means is mounted to the ink supplying apparatus in the rotary press in accordance with the present invention (with the portion associated with driving means being omitted; see FIG. 1).
Figure 3:
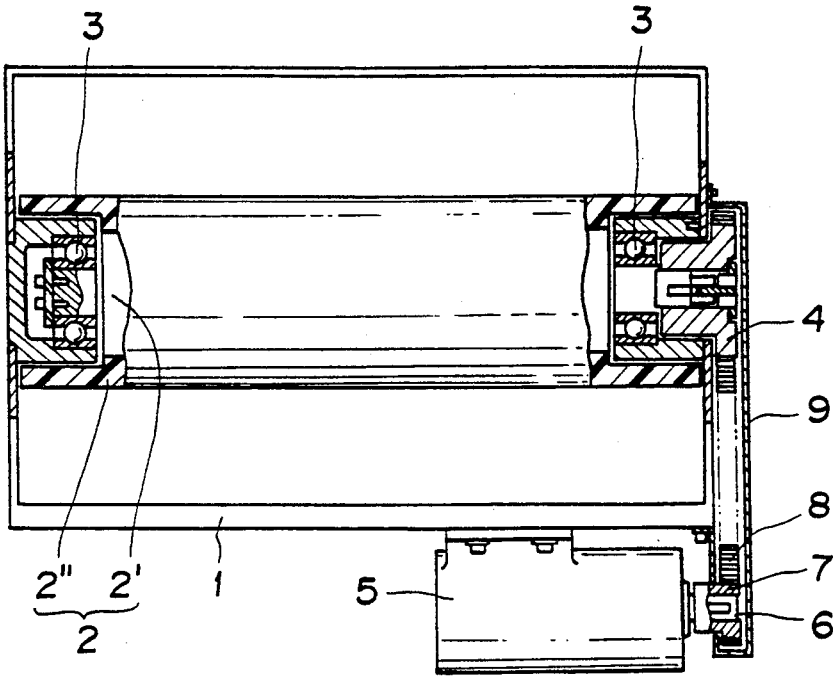
FIG. 3 is a partial sectional plan view of the ink supplying apparatus in a rotary press in the embodiment of the present invention (with the portion associated with a bed portion being omitted; see FIG. 1)

Doctor means 50 can be fitted to the ink fountain 1, whenever necessary, as shown in FIG. 6.

More in detail, a holder 52 for clamping a doctor blade 51 adjacent to the peripheral surface of the roller IR is held on the upper surface of a holding table 53 by suitable means so that its position in the moving direction can be adjusted. The intermediate portion of the holding table 53 is pivoted to a bracket 54 fitted to the front side wall portion of the ink fountain 1 in such a manner as to be capable of inclining freely round the axis of the ink fountain 1 in the transverse direction. A hydraulic cylinder 55 is interposed between the rear end of the holding table 53 and the bracket 54 so that the doctor blade 51 can come into contact with, and separate from, the peripheral surface of the roller IR when this cylinder 55 operates.

Incidentally, though the doctor blade 51 can come into contact with, and separate from, the peripheral surface of the roller IR in the embodiment shown in the drawings, it may be constituted in such a manner as to be capable of coming into contact with, and separating from, the peripheral surface of the fountain roller 2.

The doctor means 50 having the construction described above can shorten the length of the doctor blade 51, and can be handled easily. Its support mechanism can also be simplified and its weight can be reduced. Furthermore, adjustment accuracy of the doctor blade 51 under the adjacent or contact state with the peripheral surface of the roller IR or fountain roller 2 can be improved.

Figure 4:
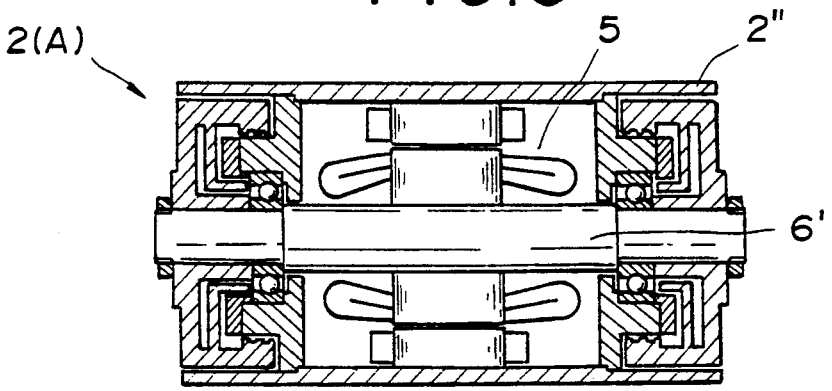
FIG. 4 is a sectional view of a fountain roller with a built-in motor in the embodiment of the present invention.
Figure 5:
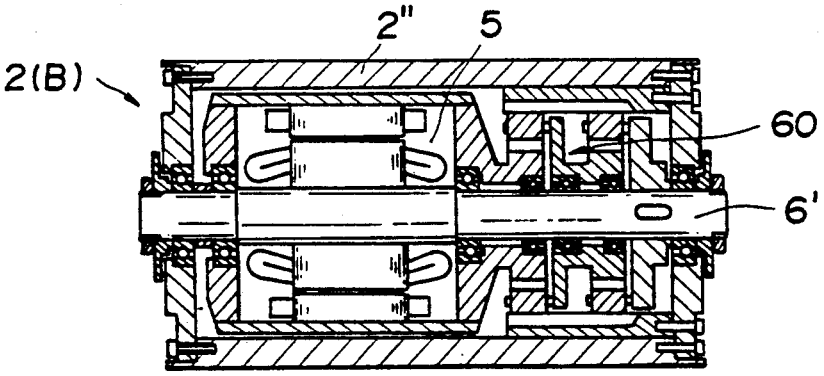
FIG. 5 is a sectional view of another fountain roller with a built-in motor in the embodiment of the present invention.

FIGS. 4 and 5 show fountain rollers 2(A) and 2(B) with a built-in motor.

In the fountain rollers 2(A) and 2(B), the motor 5 is incorporated in the outer peripheral member 2'' and both ends of the shaft 6' of the motor 5 are fixed to both side walls of the ink fountain 1.

In the fountain roller 2(A), a stator is disposed on the shaft 6' of the motor 5 and this shaft 6' is fixed as described above. The rotor is directly fitted to the outer peripheral member 2'' of the fountain roller supported rotatably on this shaft 6' through the bearing.

In the fountain roller 2(B), the outer peripheral member 2'', which is supported rotatably by the shaft 6' of the motor 5 through the bearing, is further coupled with the rotor side through a planetary gear reduction mechanism 60.

Incidentally, a shaft seal is applied to prevent ink from entering the outer peripheral member 2''.

If the fountain roller is of the built-in motor type as described above, the ink supplying apparatus IS can be made compact in size, space can be saved, and safety can be improved because the transmission mechanism is not exposed.

The operation and function of the ink supplying apparatus in the rotary press described above will be explained.

First of all, each ink supplying apparatus IS is placed on the ink supplying apparatus fitting portion F at the position at which ink supply is required in the maximum printing width, and is pushed forward. Then, the bed 20 moves forward gently while being supported by the casters 31 for movement. After the back of the front suspension wall 24 of the bed 20 comes into contact in this manner with the front side surface of the ink supplying apparatus fitting portion F, the lower end of the front suspension wall portion 24 is supported on the front step portion F1 of the ink supplying apparatus fitting portion F and the ink supplying apparatus IS is positioned to a predetermined position.

Then, the female screw 45 is operated so as to slide the slidable piece 42 along the guide rod 41 and is positioned on the front surface of the front suspension wall portion 24 of the bed 20. Then, the female screw 45 is rotated and fastened so as to push and fix the front suspension wall portion 24 of the bed 20 to the front side surface of the ink supplying apparatus fitting portion F. In this manner, each fountain roller 2 is adjacent to the roller IR of the rotary press at a predetermined position in the longitudinal direction.

Adjustment of the contact state or gap between the opposed peripheral surface of the fountain roller 2 and roller IR is made by rotating the eccentric cam 27 through the worm 29 and the worm wheel 28 by rotating the operation shaft 30. Due to the rotation of the eccentric cam 27 coming into contact with the bottom surface of the ink fountain 1, the ink fountain 1 inclines round the axis of the hinges 25 and the fountain roller 2 comes into contact with, or separates from, the roller IR, thereby adjusting the contact state or gap between the opposed peripheral surface of the fountain roller 2 and the roller IR.

Thereafter, ink is supplied into the ink fountain 1 and the lower peripheral surface of the fountain roller 2 is dipped into ink. Then, each motor 5 is connected to each rotating speed controller 12 by the connector 11.

The supply of ink into the ink fountain 1 may be effected before the ink supplying apparatus IS is fitted to the ink supplying apparatus fitting portion F.

After the standard operation described above, the rotary press is operated. Then, the motor 5 is subjected to operation control at the rotating speed in accordance with the operating speed of the rotary press by the rotation speed controller 12.

The fountain roller 2 is driven for rotation at a speed which is controlled through the toothed pulley-timing belt transmission mechanism.

In the case of the fountain roller 2(A) of the built-in motor type, the rotation of the motor 5 becomes directly the rotation of the fountain roller. In the case of the fountain roller 2(B), the rotation of the motor 5 is reduced through the planetary gear reduction mechanism 60 and becomes the rotation of the fountain roller 2.

Ink inside the ink fountain 1 is guided out from the peripheral surface of the rotating fountain roller 2, is transferred to the peripheral surface of the adjacent ink rollers IR and is sequentially transferred and supplied to the plate surface (not shown) through the ink supply path.

When the rotating state of the fountain roller 2 becomes unsuitable during the operation of the rotary press or when it is believed to become unsuitable when operating the rotary press, the rotation speed controller 12 is regulated so as to correct the rotating speed of the motor 5, that is, the fountain roller 2. This rotating speed correction can be made individually for each fountain roller 2. Ink that has been consumed by the operation of the rotary press can be supplemented suitably into the ink fountain 1 by known means.

After the operation of the rotary press is finished or, if there is an exchange of colored ink, the ink supplying apparatus IS is removed from the ink supplying apparatus fitting portion F in a sequence opposite to that described above, and the ink supply path ranging from the roller IR to the plate surface is automatically washed. In the case of the changing of ink, the ink supplying apparatuses IS having fresh ink are fitted to the ink supplying apparatus fitting portion F in the fitting sequence described above.

If the ink supplying apparatus IS is equipped with the doctor means 50, the sliding position of the holder 52 of the doctor means 50 is adjusted on the holding table 53 and the doctor blade 51 is adjusted to the suitable approach or contact state with respect to the peripheral surface of the roller IR (or the fountain roller 2). When the hydraulic cylinder 55 is operated, the holding table 53 is rotated and the doctor blade 51 with respect to the roller IR (or the fountain roller 2). In this apparatus, since the doctor means 50 can be fitted and removed integrally with the ink fountain 1 and with the fountain roller 2, the washing operation of the doctor means can be eliminated in the case of the changing of ink after completion of printing.

The ink supplying apparatus in the rotary press in accordance with the present invention can supply different kinds of ink, including ink of various colors, to portions of the rotary press having mutually different maximum printing widths and can exchange ink for each of the portions at the maximum printing width. Needless to say, the ink supplying apparatus of the invention can supply different kinds of ink and can make their exchange extremely quickly and easily. Furthermore, since the fountain roller disposed in the ink fountain can be rotated by correcting and controlling its peripheral speed to an arbitrary peripheral speed separately from the operating speed of the rotary press, ink inside the ink fountain can be guided out appropriately and supplied to the printing plate, and the scatter of ink and entrapment of air into ink can be prevented without unnecessarily stirring ink inside the ink fountain.

Accordingly, the present invention can cope with the high speed operation of the rotary press. Since the apparatus of the invention is simple in construction, its maintenance and inspection can be made easily. In addition, since the transmission mechanism is integral with the ink supplying apparatus, transmission can be made reliably and safely.

We claim:

1. An ink supplying apparatus in a rotary press having a frame portion comprising:

a plurality of ink fountains, each having a width smaller than the maximum printing width of said rotary press;

a fountain roller disposed rotatably in each of said ink fountains;

independent rotation driving means for each of said fountain rollers, each ink fountain having its associated driving means, fitted integrally thereto;

a rotation speed controller connected to said rotation driving means and including means to control the rotational speed of each fountain roller independently of the remaining fountain roller; and a fixing device for removably fitting each of said ink fountains to said frame portion of said rotary press at a suitable longitudinal position along the maximum printing width, and means to independently adjust the longitudinal position of each ink fountain.

2. An ink supplying apparatus in a rotary press according to claim 1, wherein said ink fountain is fitted to a fixing device in such a manner that its inclining position round the axis in a transverse direction can be adjusted freely.

3. An ink supplying apparatus in a rotary press according to claim 1 or 2, which further comprises a doctor blade disposed in said ink fountain in such a manner as to come into contact with, and separate from, the peripheral surface of an ink roller adjacent to said fountain roller or the peripheral surface of said fountain roller.

* * * * *